US011834323B2

(12) United States Patent
Johnson et al.

(10) Patent No.: US 11,834,323 B2
(45) Date of Patent: Dec. 5, 2023

(54) HYDROCARBON TRANSPORT AT MARINE TERMINALS

(71) Applicant: Buckeye Partners, L.P., Houston, TX (US)

(72) Inventors: Clinton D. Johnson, Houston, TX (US); Brett Buzbee, Houston, TX (US); Alvin Johnson, III, Corpus Christi, TX (US); Matthew Barrow, Corpus Christi, TX (US); Francesco A. Inzone, Portland, TX (US)

(73) Assignee: Buckeye Partners, L.P., Houston, TX (US)

( * ) Notice: Subject to any disclaimer, the term of this patent is extended or adjusted under 35 U.S.C. 154(b) by 71 days.

(21) Appl. No.: 17/230,583

(22) Filed: Apr. 14, 2021

(65) Prior Publication Data

US 2022/0332565 A1 Oct. 20, 2022

(51) Int. Cl.
*B67D 9/02* (2010.01)
*F17C 9/02* (2006.01)

(52) U.S. Cl.
CPC ..... *B67D 9/02* (2013.01); *F17C 9/02* (2013.01); *F17C 2221/032* (2013.01)

(58) Field of Classification Search
CPC ..... F17C 9/00; F17C 9/02; F17C 2221/032; B67D 9/00; B67D 9/02
See application file for complete search history.

(56) References Cited

U.S. PATENT DOCUMENTS

| | | | | |
|---|---|---|---|---|
| 7,032,816 | B2 | 4/2006 | Markham et al. | |
| 2006/0156744 | A1* | 7/2006 | Cusiter | F17C 7/04 62/53.2 |
| 2007/0130963 | A1* | 6/2007 | Morrison | F17C 9/02 62/260 |
| 2010/0332273 | A1 | 12/2010 | Balasubramanian et al. | |
| 2012/0234024 | A1* | 9/2012 | Street | F17C 9/02 62/48.1 |

(Continued)

OTHER PUBLICATIONS

Buckeye.com [online], "International Trade Logistics and Potential Savings Opportunities" Sep. 2012, [retrieved on Jul. 23, 2021], retrieved from: URL <https://www.buckeye.com/BusinessOperations/TerminalOperations/InternationalTradeLogistics/tabid/741/Default.aspx>, 2 pages.

(Continued)

*Primary Examiner* — Paul J Gray
(74) *Attorney, Agent, or Firm* — Fish & Richardson P.C.

(57) ABSTRACT

An input includes a specified fluid product to be transported, a specified volume transfer of the specified fluid product to a berth, and a target flow rate of the specified fluid product. A first allowable operating range for volume transfer and a second allowable operating range for flow rate are determined at least based on: the specified fluid product, an availability of meters for metering, an availability of loading arms for loading the specified fluid product to a ship located at the berth, and an availability of vapor combustion units for flaring. A control signal is transmitted to at least one of multiple valves to establish a flow path for the specified fluid product. A start signal is transmitted to initiate a recipe that controls flow through the flow path within the first allowable operating range and the second allowable operating range.

8 Claims, 3 Drawing Sheets

(56) References Cited

U.S. PATENT DOCUMENTS

| | | | | |
|---|---|---|---|---|
| 2016/0265722 | A1* | 9/2016 | Voelker | F17C 7/02 |
| 2017/0300026 | A1* | 10/2017 | Alden | G05B 15/02 |
| 2018/0283616 | A1* | 10/2018 | Roska | F17C 5/02 |

OTHER PUBLICATIONS

Buckeyeglobalmarine.com [online], "About GMT" Apr. 2015, [retrieved on Jul. 23, 2021], retrieved from: URL <http://buckeyeglobalmarine.com/about-us/>, 3 pages.

Buckeyeglobalmarine.com [online], "Texas Hub" Aug. 2015, [retrieved on Jul. 23, 2021], retrieved from : URL <http://buckeyeglobalmarine.com/locations/texas-hub/>, 4 pages.

* cited by examiner

HYDROCARBON TRANSPORT AT MARINE TERMINALS

TECHNICAL FIELD

This disclosure relates to hydrocarbon transport, and in particular, in relation to marine terminals.

BACKGROUND

Oil terminals are industrial facilities for storing hydrocarbon products and derivatives, such as crude oil, petroleum, and petrochemicals. Such products can be transported from an oil terminal to an end user or another storage facility. Oil terminals can include above ground tankage, underground tankage, or both. In some cases, oil terminals are located close to or are integrated with oil refineries.

SUMMARY

Certain aspects of the subject matter described can be implemented as a method. An input is received. The input includes a specified fluid product to be transported, a specified volume transfer of the specified fluid product to a berth, and a target flow rate of the specified fluid product. A first allowable operating range for volume transfer and a second allowable operating range for flow rate are determined at least based on: the specified fluid product, an availability of meters for metering, an availability of loading arms for loading the specified fluid product to a ship located at the berth, and an availability of vapor combustion units for flaring. A control signal is transmitted to at least one of multiple valves to establish a flow path for the specified fluid product through the meters available for metering, through the loading arms available for loading, and to the ship located at the berth. A start signal is transmitted to initiate a recipe that controls flow through the flow path within the first allowable operating range and the second allowable operating range.

This, and other aspects, can include one or more of the following features.

In some implementations, the input includes a selection of at least one of multiple source tanks and a selection of at least one of multiple pumps. In some implementations, each of the source tanks store fluid of one of multiple product types. In some implementations, the method includes verifying that the specified fluid product matches the product type of the selection of the source tanks.

In some implementations, transmitting the control signal to at least one of the valves includes transmitting a close signal to each of a first portion of the valves, resulting in shifting the first portion of the valves to a closed state. In some implementations, transmitting the control signal to at least one of the valves includes transmitting an open signal to each of a second portion of the valves, resulting in shifting the second portion of the valves to an open state. The first portion of the valves in the closed state and the second portion of the valves in the open state can establish the flow path.

In some implementations, after transmitting the close signal to each of the first portion of the valves and after transmitting the open signal to each of the second portion of the valves, the method includes verifying whether a conflict exists in the flow path established. In some implementations, verifying whether a conflict exists in the flow path established includes determining at least one of: any of the selection of the source tanks is in fluid communication with an inbound pipeline or an inbound berth flush line, any of the selection of the source tanks is in fluid communication with a flush pump suction, any of the selection of the source tanks is in fluid communication with any of the pumps that is not in the selection of the pumps, any of the selection of the pumps is in fluid communication with any of the source tanks that is not in the selection of the source tanks, a berth cargo line is not in fluid communication with a pump discharge, a discharge of any of the selection of the pumps is not in fluid communication with the berth cargo line, or the berth cargo line is in fluid communication with a discharge of any of the pumps that is not in the selection of the pumps.

In some implementations, the source tanks, the pumps, the meters, the loading arms, and the vapor combustion units are monitored for a change in state. In some implementations, in response to detecting the change in state, a notification that the change in state has been detected is displayed. In some implementations, a stop signal is transmitted to terminate the recipe in response to detecting the change in state. In some implementations, a stop signal is transmitted to terminate the recipe in response to not receiving a second input within a predetermined time period after the notification has been displayed. In some implementations, a second input is received after displaying the notification. In some implementations, in response to receiving the second input, a confirmation request is displayed repeatedly at a predetermined rate until the recipe has completed.

Certain aspects of the subject matter described can be implemented as an apparatus for hydrocarbon transport at a marine terminal. The apparatus includes a processor and a computer-readable storage medium coupled to the processor and storing programming instructions for execution by the processor. In some implementations, the computer-readable storage medium is non-transitory. The programming instructions instruct the processor to perform operations including receiving an input. The input includes a specified fluid product to be transported, a specified volume transfer of the specified fluid product to a berth, and a target flow rate of the specified fluid product. The operations include determining a first allowable operating range for volume transfer and a second allowable operating range for flow rate at least based on the specified fluid product, an availability of meters for metering, an availability of loading arms for loading the specified fluid product to a ship located at the berth, and an availability of vapor combustion units for flaring. The operations include transmitting a control signal to at least one of multiple valves to establish a flow path for the specified fluid product through the meters available for metering, through the loading arms available for loading, and to the ship located at the berth. The operations include transmitting a start signal to initiate a recipe that controls flow through the flow path within the first allowable operating range and the second allowable operating range.

This, and other aspects, can include one or more of the following features.

In some implementations, the input includes a selection of at least one of multiple source tanks and a selection of at least one of multiple pumps. In some implementations, each of the source tanks store fluid of one of multiple product types. In some implementations, the operations include verifying that the specified fluid product matches the product type of the selection of the source tanks.

In some implementations, transmitting the control signal to at least one of the valves includes transmitting a close signal to each of a first portion of the valves, resulting in shifting the first portion of the valves to a closed state. In some implementations, transmitting the control signal to at least one of the valves includes transmitting an open signal to each of a second portion of the valves, resulting in shifting the second portion of the valves in an open state. The first portion of the valves in the closed state and the second portion of the valves in the open state can establish the flow path.

In some implementations, the operations include, after transmitting the close signal to each of the first portion of the valves and after transmitting the open signal to each of the second portion of the valves, verifying whether a conflict exists in the flow path established. In some implementations, verifying whether a conflict exists in the flow path established includes determining at least one of: any of the selection of the source tanks is in fluid communication with an inbound pipeline or an inbound berth flush line, any of the selection of the source tanks is in fluid communication with a flush pump suction, any of the selection of the source tanks is in fluid communication with any of the pumps that is not in the selection of the pumps, any of the selection of the pumps is in fluid communication with any of the source tanks that is not in the selection of the source tanks, a berth cargo line is not in fluid communication with a pump discharge, a discharge of any of the selection of the pumps is not in fluid communication with the berth cargo line, or the berth cargo line is in fluid communication with a discharge of any of the pumps that is not in the selection of the pumps.

In some implementations, the operations include monitoring the source tanks, the pumps, the meters, the loading arms, and the vapor combustion units for a change in state. In some implementations, the operations include, in response to detecting the change in state, displaying a notification that the change in state has been detected. In some implementations, the operations include transmitting a stop signal to terminate the recipe in response to detecting the change in state. In some implementations, the operations include transmitting a stop signal to terminate the recipe in response to not receiving a second input within a predetermined time period after the notification has been displayed. In some implementations, the operations include receiving a second input after displaying the notification. In some implementations, the operations include, in response to receiving the second input, displaying a confirmation request repeatedly at a predetermined rate until the recipe has completed. In some implementations, the operations include transmitting a stop signal to terminate the recipe in response to not receiving a confirmation within a predetermined time period after the confirmation request has been displayed.

Certain aspects of the subject matter described can be implemented as a hydrocarbon transport marine terminal system. The system includes source tanks, pumps, meters, loading arms, vapor combustion units, a berth, and a flow system. The flow system includes a network of piping connecting the source tanks, the pumps, the meters, the loading arms, and the vapor combustion units. The flow system includes valves installed in the network of piping. The flow system includes a computer. The computer includes a processor and a computer-readable storage medium coupled to the processor and storing programming instructions for execution by the processor. In some implementations, the computer-readable storage medium is non-transitory. The programming instructions instruct the processor to perform operations including receiving an input. The input includes a specified fluid product to be transported, a specified volume transfer of the specified fluid product to the berth, and a target flow rate of the specified fluid product. The operations include determining a first allowable operating range for volume transfer and a second allowable operating range for flow rate at least based on the specified fluid product, an availability of meters for metering, an availability of loading arms for loading the specified fluid product to a ship located at the berth, and an availability of vapor combustion units for flaring. The operations include transmitting a control signal to at least one of the valves to establish a flow path for the specified fluid product through the meters available for metering, through the loading arms available for loading, and to the ship located at the berth. The operations include transmitting a start signal to initiate a recipe that controls flow through the flow path within the first allowable operating range and the second allowable operating range.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

A hydrocarbon transport marine terminal includes multiple storage tanks for storing hydrocarbon products and/or derivatives. The products can be supplied, for example, by a pipeline or a nearby crude oil refinery. The hydrocarbon transport marine terminal includes ship loading and unloading equipment, such that the products can be transported to and from ships that are docked at berths of the terminal. The control of fluid flow in the terminal can be complicated by various factors, such as having multiple product types being stored and transported in the terminal that need to avoid cross-contamination and number of equipment available for active transporting. By implementing the systems and methods described, hydrocarbons can be efficiently and safely transported into and out of a marine terminal. The systems and methods described can be implemented to mitigate or eliminate risks associated with hydrocarbon transport, for example, loss of containment or product contamination, by reducing the number of operations performed by a human operator and therefore reducing the risk of operator error. The systems and methods described can be implemented to mitigate or eliminate risks of equipment damage, for example, associated with improper lineups for fluid transport in the terminal.

Figure 1:
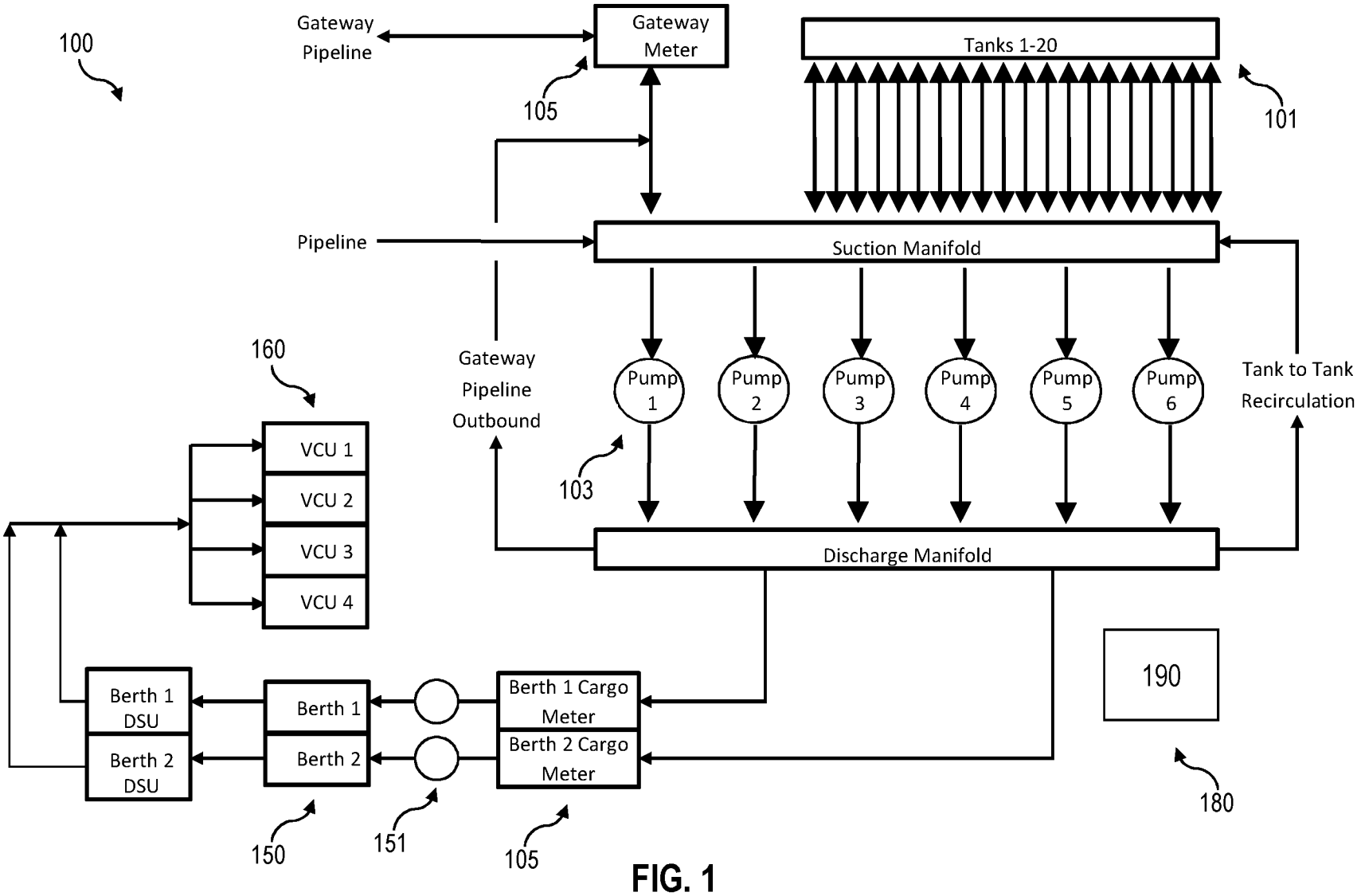
FIG. 1 is a flow diagram of an example hydrocarbon transport marine terminal.

FIG. 1 is a flow diagram of an example hydrocarbon transport marine terminal 100. Hydrocarbons can be transported into the terminal 100, for example, from a pipeline. Hydrocarbons can be transported out of the terminal 100, for example, to a pipeline or to a tankship docked at a berth 150. The terminal 100 includes source tanks 101 and pumps 103. Although shown in FIG. 1 as including twenty source tanks 101, the terminal 100 can include fewer or additional source tanks 101. The source tanks 101 can temporarily store volumes of hydrocarbons, for example, in between inbound and outbound transfer operations at the terminal 100. Although shown in FIG. 1 as including six pumps 103, the terminal 100 can include fewer or additional pumps 103. In some implementations, each of the pumps 103 are designated for a respective one of the source tanks 101. In some implementations, any of the pumps 103 can be used to pump fluid from any of the source tanks 101. In some implementations, multiple pumps 103 are used to pump fluid from one of the source tanks 101 at a time. In some implementations, multiple pumps 103 are used to pump fluid from several source tanks 101 at a time. In some implementations, the source tanks 101 are fluidically coupled together by a pump suction manifold. Fluid can flow from the pump suction manifold to any of the source tanks 101, and fluid can flow from any of the source tanks 101 to the pump suction manifold. In some implementations, the discharges of the pumps 103 are fluidically coupled together by a pump discharge manifold. Although shown in FIG. 1 as including a single pump suction manifold and a single pump discharge manifold, the terminal 100 can include additional manifolds.

In some implementations, each of the source tanks 101 are designated for a specific hydrocarbon product type, where each hydrocarbon product type have different density specifications or other characteristics. For example, a first portion of the source tanks 101 are designated for a first hydrocarbon product type (such as "heavy"), and a second portion of the source tanks 101 are designated for a second hydrocarbon product type (such as "light"). For example, a first portion of the source tanks 101 are designated for a first hydrocarbon product type (such as "heavy"), a second portion of the source tanks 101 are designated for a second hydrocarbon product type (such as "intermediate"), and a third portion of the source tanks 101 are designated for a third hydrocarbon product type (such as "light").

The terminal 100 includes meters 105 at various locations in the terminal 100. Although shown in FIG. 1 as including three meters 105, the terminal 100 can include fewer or additional meters 105. In some implementations, the terminal 100 includes meter(s) 105 downstream of the pump discharge manifold. In some implementations, the terminal 100 includes meter(s) 105 upstream of the pump suction manifold. The meters 105 can be used to measure characteristics of the fluid flowing through the piping where each meter 105 is located. In some implementations, the meters 105 are configured to measure volumetric flow, mass flow, or both. In some implementations, the meters 105 are configured to measure additional characteristics, such as density, temperature, and pressure. In some implementations, the terminal 100 includes sampling stations that take samples of a fluid being transported in the terminal 100. The samples can be analyzed to measure characteristics, such as water content and contamination concentration.

The terminal 100 includes berths 150 at which tankships can dock. Although shown in FIG. 1 as including two berths 150, the terminal 100 can include fewer or additional berths 150. The terminal 100 includes berth loading arms 151 located at the berths 150. Although shown in FIG. 1 as including two berth loading arms 151, the terminal 100 can include fewer or additional berth loading arms 151. Each of the berth loading arms 151 are configured to connect to a tankship to transfer fluid to the tankship docked at the respective berth 150. In some implementations, each of the berth loading arms 151 includes a mechanical arm that includes articulated steel pipes. In some implementations, each of the berth loading arms 151 includes swivel joints, quick-connect fittings, and gasket or 0-ring seals. In some implementations, each of the berth loading arms 151 are designated for a respective one of the berths 150. In some implementations, multiple berth loading arms 151 are designated for each of the berths 150.

In some implementations, fluid flows from a pipeline to a source tank 101. For example, in an inbound transfer operation, fluid can flow from a pipeline, through the pump suction manifold, and to a source tank 101. As another example of an inbound transfer operation, fluid can flow from a pipeline, through a meter 105, through the pump suction manifold, and to a source tank 101.

In some implementations, fluid flows from the pump discharge manifold to the pump suction manifold to transfer fluid between source tanks 101. For example, in a tank-to-tank transfer operation, fluid can flow from one of the source tanks 101, through the pump suction manifold, through a pump 103, through the pump discharge manifold, back through the pump suction manifold, and to another one of the source tanks 101. As another example of a tank-to-tank transfer operation, fluid can flow from one of the source tanks 101, through the pump suction manifold, and to another one of the source tanks 101 utilizing gravity instead of relying on a pressure boost from the pumps 103.

In some implementations, fluid flows from the pump discharge manifold to a pipeline. For example, in a pipeline outbound transfer operation, fluid can flow from a source tank 101, through the pump suction manifold, through a pump 103, through the pump discharge manifold, through a meter 105, and to the pipeline.

In some implementations, fluid flows from the pump discharge manifold to a berth 150. For example, in a berth outbound transfer operation, fluid can flow from a source tank 101, through the pump suction manifold, through a pump 103, through the pump discharge manifold, through a meter 105, through a berth loading arm 151, and to a tankship docked at a berth 150. As fluid is transferred to a tankship docked at a berth 150, volatile components can flash. Further, hydrocarbon liquid can displace vapor from the tankship. In some implementations, such vapors flow through dock safety units (abbreviated "DSU" in FIG. 1) and to vapor combustion units 160 (abbreviated "VCU" in FIG. 1), where the vapors are combusted, which is also referred as flaring. Although shown in FIG. 1 as including four vapor combustion units 160, the terminal 100 can include fewer or additional vapor combustion units 160.

Figure 3:
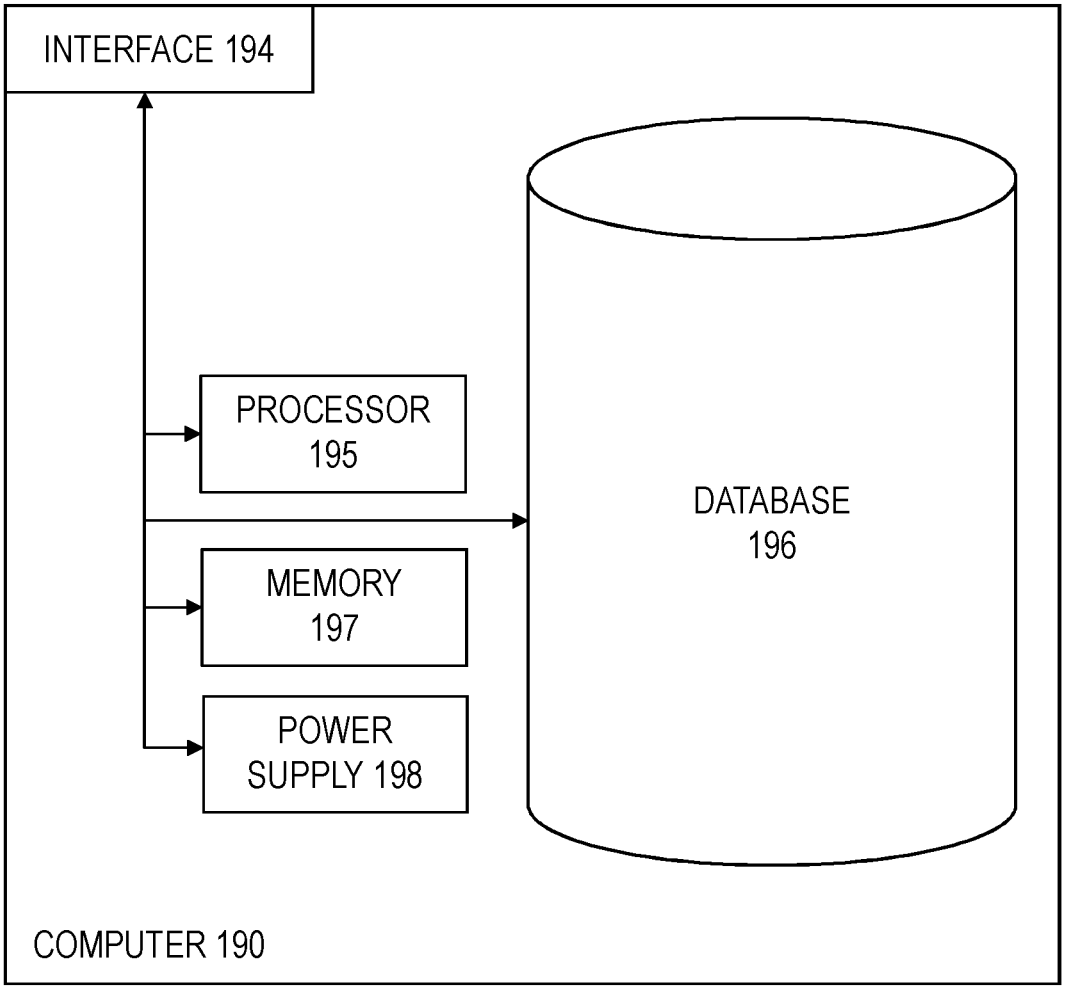
FIG. 3 is a block diagram of an example computer system.

The terminal 100 includes a flow control system 180 that includes a network of piping (represented by the flow arrows in FIG. 1), valves installed in the network of piping, and a computer 190. The network of piping fluidically couple together various components of the terminal 100. For example, the network of piping connects the source tanks 101, the pumps 103, the meters 105, the berth loading arms 151, and the vapor combustion units 160. Fluid flow in the terminal 100 can be controlled by closure and opening of valves distributed across the network of piping in the terminal 100. For example, a first portion of the valves distributed across the network of piping are in an open state while a remaining portion of the valves are in a closed state to establish a flow path from a desired source to a desired destination while preventing flow from different source(s) and preventing flow to different destination(s). Different configurations of open/closed valves can be implemented for the desired transfer operation (for example, tank-to-tank transfer, inbound transfer, pipeline outbound transfer, and berth outbound transfer). The computer 190 is communicatively coupled to the valves and is configured to control the opening and closing of the valves. The computer 190 is configured to control fluid flow through the network of piping in the terminal 100. In some implementations, the computer 190 is communicatively coupled to various components of the terminal 100. For example, the computer 190 can be communicatively coupled to the source tanks 101, the pumps 103, the meters 105, the loading arms 151, and the vapor combustion units 160. Although shown in FIG. 1 as including a single computer 190, the terminal 100 can include additional computers 190. An implementation of the computer 190 is also shown in FIG. 3 and is described in more detail later.

Figure 2:
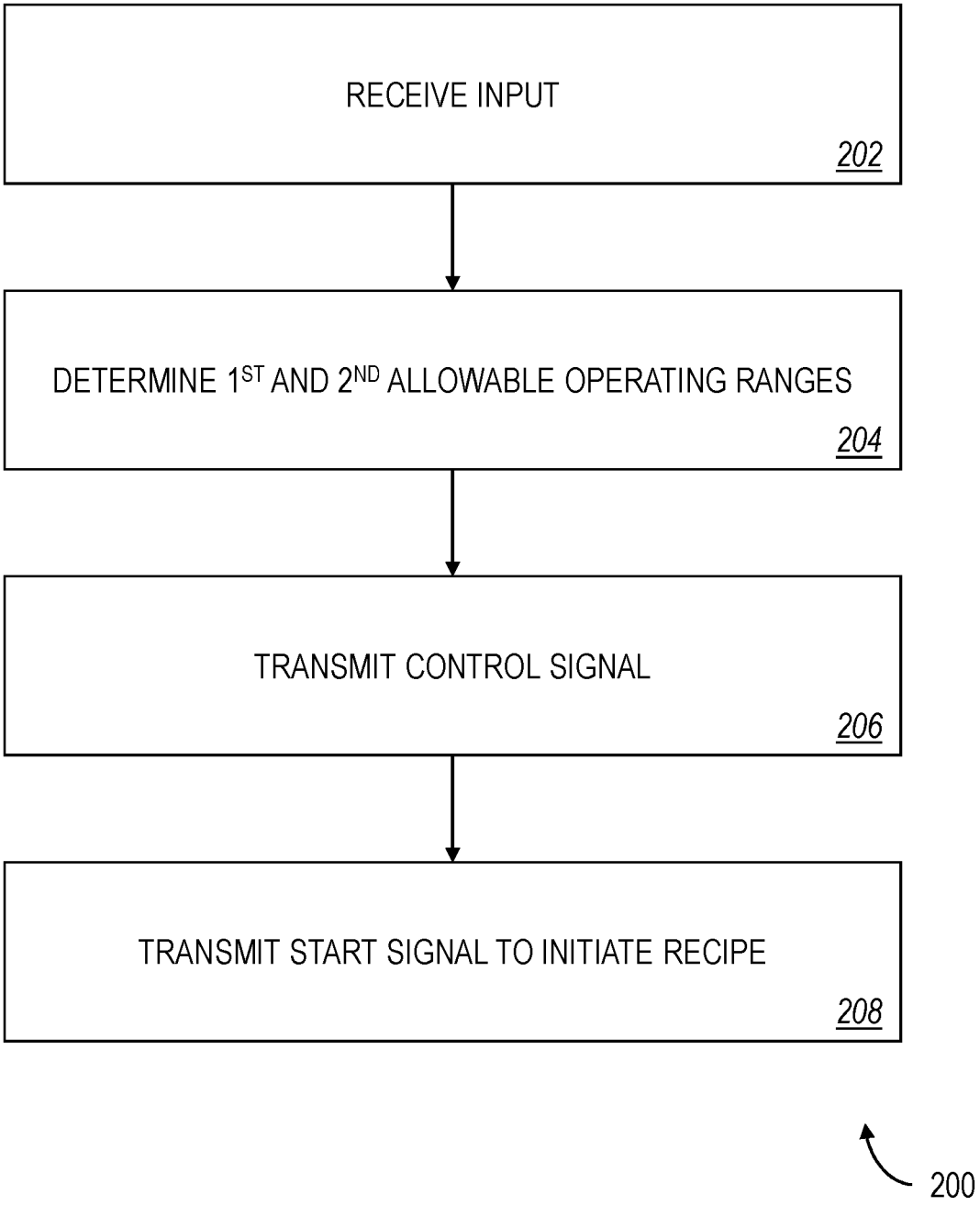
FIG. 2 is a flow chart of an example method for hydrocarbon transport.

FIG. 2 is a flow chart of an example method 200 for hydrocarbon transport at a marine terminal, such as the marine terminal 100. The method 200 can be implemented, for example, by the computer 190. At step 202, an input is received, for example, by the processor 191 from an operator. The input includes a specified fluid product to be transported. The input includes a specified volume transfer of the specified fluid product to the berth 150. The input includes a target flow rate of the specified fluid product. In some implementations, the input includes a selection of at least one of the source tanks 101. In some implementations, the input includes a selection of at least one of the pumps 103.

At step 204, a first allowable operating range for volume transfer and a second allowable operating range for flow rate are determined. The first and second allowable operating ranges are determined at step 204 at least based on the specified fluid product (from the input), an availability of meters 105 for metering, an availability of berth loading arms 151 available for loading the fluid to a tankship docked at the berth 150, and an availability of vapor combustion units 160 available for flaring. In some implementations, the first and second allowable operating ranges are determined at step 204 also based on the selected source tanks 101 and the selected pumps 103 from the input.

In some implementations, each of the source tanks 101 have a maximum volume of fluid available to be pumped from the respective source tank 101 before reaching a point at which a floating roof disposed within the respective source tank 101 lands. In some implementations, this maximum volume is defined as the difference between the respective source tank's current liquid volume and its low-level alarm setpoint. In some implementations, this maximum volume affects the determination of the first allowable operating range for volume transfer. In some implementations, each of the source tanks 101 have a maximum design flow rate. In some implementations, this maximum design flow rate affects the determination of the second allowable operating range for flow rate.

In some implementations, each of the pumps 103 have a minimum flow rate and a maximum flow rate of the fluid that they can pump. In some implementations, the minimum flow rates of the pumps 103 are the same. In some implementations, the minimum flow rates of the pumps 103 are different. In some implementations, the maximum flow rates of the pumps 103 are the same. In some implementations, the maximum flow rates of the pumps 103 are different. In some implementations, both the number of pump 103 selected (from the input) and the minimum and maximum flow rates of the selected pumps 103 affect the determination of the second allowable operating range for flow rate.

In some implementations, each of the meters 105 have a minimum flow rate and a maximum flow rate of the fluid that they can meter. In some implementations, the minimum flow rates of the meters 105 are the same. In some implementations, the minimum flow rates of the meters 105 are different. In some implementations, the maximum flow rates of the meters 105 are the same. In some implementations, the maximum flow rates of the meters 105 are different. In some implementations, both the number of meters 105 available for metering and the minimum and maximum flow rates of the available meters 105 affect the determination of the second allowable operating range for flow rate.

In some implementations, each of the berth loading arms 151 have a maximum flow rate of the fluid that they can flow. In some implementations, the maximum flow rates of the berth loading arms 151 are the same. In some implementations, the maximum flow rates of the berth loading arms 151 are different. In some implementations, both the number of berth loading arms 151 available for loading the fluid to a tankship docked at the berth 150 and the maximum flow rates of the available berth loading arms 151 affect the determination of the second allowable operating range for flow rate.

In some implementations, each of the vapor combustion units 160 have a maximum flow rate of the fluid that they can flow. In some implementations, the maximum flow rates of the vapor combustion units 160 are the same. In some implementations, the maximum flow rates of the vapor combustion units 160 are different. In some implementations, both the number of vapor combustion units 160 available for flaring and the maximum flow rates of the available vapor combustion units 160 affect the determination of the second allowable operating range for flow rate.

At step 206, a control signal is transmitted to at least one of the valves installed and distributed across the network of piping to establish a flow path for the specified fluid product (from the input) through the meters available for metering, through the loading arms available for loading, and to the tankship docked at the berth 150. In some implementations, step 206 includes transmitting a close signal to a first portion of the valves installed and distributed across the network of piping, resulting in shifting the first portion of valves to a closed state. In some implementations, step 206 includes transmitting an open signal to a second portion of the valves installed and distributed across the network of piping, resulting in shifting the second portion of valves to an open state. The first portion of valves in the closed state and the second portion of valves in the open state (and in some cases, a remaining portion of valves that did not shift in position and remained open or closed, for example, from a previous transfer operation) can establish the flow path through the meters 105 available for metering, through the berth loading arms 151 available for loading, and to the tankship docked at the berth 150.

At step 208, a start signal is transmitted to initiate a recipe that controls fluid flow through the flow path (established by step 206) within the first allowable operating range and the second allowable operating range (determined at step 204).

In some implementations, the method 200 includes verifying that the desired product type (from the input) matches the product type associated with the selected source tanks 101. In some implementations, the product type verification is performed before transmitting the start signal at step 208. In some implementations, the product type verification is performed before transmitting the control signal at step 206. In some implementations, the product type verification is performed before determining the first and second allowable operating ranges at step 204.

In some implementations, the method 200 includes verifying whether a conflict exists in the flow path established from step 206. In some implementations, the conflict verification is performed before transmitting the start signal at step 208. In some implementations, the conflict verification includes determining whether any of the selected source tanks 101 from the input is in fluid communication with an inbound pipeline or an inbound berth flush line. In some implementations, the conflict verification includes determining whether any of the selected source tanks 101 from the input is in fluid communication with a flush pump suction. In some implementations, the conflict verification includes determining whether any of the selected source tanks 101 from the input is in fluid communication with any pump(s) 103 that is not one of the selected pumps 103 from the input. In some implementations, the conflict verification includes determining whether any of the selected pumps 103 from the input is in fluid communication with any source tank(s) 101 that is not one of the selected source tanks 101 from the input. In some implementations, the conflict verification includes determining whether a berth cargo line is not in fluid communication with a pump discharge. In some implementations, the conflict verification includes determining whether a discharge of any of the selected pumps 103 from the input is in fluid communication with to the berth cargo line. In some implementations, the conflict verification includes determining whether the berth cargo line is in fluid communication with a discharge of any pump(s) 103 that is not one of the selected pump 103 from the input.

In some implementations, the method 200 includes monitoring the source tanks 101, the pumps 103, the meters 105, the berth loading arms 151, and the vapor combustion units 160 for a change in state. For example, the pumps 103 are monitored for loss of power. For example, the vapor combustion units 160 are monitored for unexpected flaring operations, during which flaring capacity designated for the recipe being executed may be reduced. In some implementations, the method 200 includes monitoring the valves for a change in state. For example, a valve that is expected to be closed for a duration of a recipe opens for an unknown reason during execution of the recipe, or a valve that is expected to be open for a duration of a recipe closes for an unknown reason during execution of the recipe. In some cases, the opening or closing of the valve (change in state) affects the flow path established from step 206, and the recipe may need to be terminated. In some implementations, the monitoring is performed repeatedly and/or continuously after the start signal is transmitted at step 208. In some implementations, the method 200 includes, in response to detecting the change in state, transmitting a stop signal to terminate the recipe. In some implementations, the method 200 includes, in response to detecting the change in state, displaying a notification that the change in state has been detected. In some implementations, the method 200 includes transmitting a stop signal to terminate the recipe in response to not receiving a second input within a predetermined time period (for example, about 1 minute, about 2 minutes, or about 3 minutes) after the notification has been displayed. In some implementations, the method 200 includes receiving a second input (for example, an updated version of the input received at step 202) after displaying the notification that the change in state has been detected. In some implementations, the method 200 includes, in response to receiving the second input, displaying a confirmation request repeatedly at a predetermined rate (for example, every 5 minutes, every 10 minutes, every 15 minutes, every 20 minutes, every 25 minutes, or every 30 minutes) until the recipe has completed (for example, the desired volume transfer of the fluid from the input has been transferred from the selected source tanks 101 to the tankship docked at the berth 150). In some implementations, the method 200 includes transmitting a stop signal to terminate the recipe in response to not receiving a confirmation within a predetermined time period (for example, about 1 minute, about 2 minutes, or about 3 minutes) after the confirmation request has been displayed.

FIG. 3 is a block diagram of an implementation of the computer 190 that can be used to provide computational functionalities associated with described algorithms, methods, functions, processes, flows, and procedures, as described in this specification. The illustrated computer 190 is intended to encompass any computing device such as a server, desktop computer, laptop/notebook computer, one or more processors within these devices, or any other processing device, including physical or virtual instances (or both) of the computing device. Additionally, the computer 190 can include a computer that includes an input device, such as a keypad, keyboard, touch screen, or other device that can accept user information, and an output device that conveys information associated with the operation of the computer 190, including digital data, visual, audio information, or a combination of information.

The computer 190 includes an interface 194. Although illustrated as a single interface 194 in FIG. 3, two or more interfaces 194 may be used according to particular needs, desires, or particular implementations of the computer 190. Although not shown in FIG. 3, the computer 190 can be communicably coupled with a network. The interface 194 is used by the computer 190 for communicating with other systems that are connected to the network in a distributed environment. Generally, the interface 194 comprises logic encoded in software or hardware (or a combination of software and hardware) and is operable to communicate with the network. More specifically, the interface 194 may comprise software supporting one or more communication protocols associated with communications such that the network or interface's hardware is operable to communicate physical signals within and outside of the illustrated computer 190.

The computer 190 includes the processor 195. Although illustrated as a single processor 195 in FIG. 3, two or more processors may be used according to particular needs, desires, or particular implementations of the computer 190. Generally, the processor 195 executes instructions and manipulates data to perform the operations of the computer 190 and any algorithms, methods, functions, processes, flows, and procedures as described in this specification.

The computer 190 can also include a database 196 that can hold data for the computer 190 or other components (or a combination of both) that can be connected to the network. Although illustrated as a single database 196 in FIG. 3, two or more databases (of the same or combination of types) can be used according to particular needs, desires, or particular implementations of the computer 190 and the described functionality. While database 196 is illustrated as an integral component of the computer 190, database 196 can be external to the computer 190.

The computer 190 also includes the memory 197 that can hold data for the computer 190 or other components (or a combination of both) that can be connected to the network. Although illustrated as a single memory 197 in FIG. 3, two or more memories 197 (of the same or combination of types) can be used according to particular needs, desires, or particular implementations of the computer 190 and the described functionality. While memory 197 is illustrated as an integral component of the computer 190, memory 197 can be external to the computer 190. The memory 197 can be a transitory or non-transitory storage medium.

The memory 197 stores computer-readable instructions executable by the processor 195 that, when executed, cause the processor 195 to perform operations, such as any of steps 202, 204, 206, and 208 of method 200. In some implementations, the computer 190 includes multiple processors 195, and the memory 197 coupled to the processors 195 stores computer-readable instructions executable by the processors 195 that, when executed, cause one or more of the processors 195 to perform the operations. The computer 190 can also include a power supply 198. The power supply 198 can include a rechargeable or non-rechargeable battery that can be configured to be either user- or non-user-replaceable. The power supply 198 can be hard-wired. There may be any number of computers 190 associated with, or external to, a computer system containing computer 190, each computer 190 communicating over the network. Further, the term "client," "user," "operator," and other appropriate terminology may be used interchangeably, as appropriate, without departing from this specification. Moreover, this specification contemplates that many users may use one computer 190, or that one user may use multiple computers 190.

EXAMPLE

Table 1 provides example allowable operating ranges for various equipment that can be included in the terminal 100. The flow rates in Table 1 are provided in barrels per hour (BPH). In this example, each source tank 101 can supply a maximum flow rate of 30,000 BPH (up to a total 90,000 BPH for 3 tanks supplying oil simultaneously). In this example, each pump 103 can provide a minimum-maximum flow rate range of 7,500 BPH-21,000 BPH (with a minimum of 7,500 BPH for 1 operating pump and a maximum of 84,000 BPH for 4 pumps operating simultaneously). In this example, each meter 105 can evaluate a minimum-maximum flow rate range of 1,500 BPH-14,500 BPH (with a minimum of 1,500 BPH for 1 available meter and a maximum of 72,500 BPH for 5 meters available for metering). For the maximum of 72,500 BPH for all 5 meters available for metering, the total 72,500 BPH flow is distributed among the 5 meters. In this example, each berth loading arm 151 can handle a maximum flow rate of 24,000 BPH (up to a total of 72,000 BPH for 3 berth loading arms loading fluid). In this example, each vapor combustion unit 160 can handle a maximum flow rate of 50,000 BPH (up to a total of 100,000 BPH for both vapor combustion units available at full capacity).

TABLE 1

| Category | Quantity | Minimum Flow Rate (BPH) | Maximum Flow Rate (BPH) |
|---|---|---|---|
| Source Tanks 101 | 1 | — | 30,000 |
| | 2 | — | 60,000 |
| | 3 | — | 90,000 |
| Pumps 103 | 1 | 7,500 | 21,000 |
| | 2 | 15,000 | 42,000 |
| | 3 | 22,500 | 63,000 |
| | 4 | 30,000 | 84,000 |
| Meters 105 | 1 | 1,500 | 14,500 |
| | 2 | 3,000 | 29,000 |
| | 3 | 4,500 | 43,500 |
| | 4 | 6,000 | 58,000 |
| | 5 | 7,500 | 72,500 |
| Berth Loading Arms 151 | 1 | — | 24,000 |
| | 2 | — | 48,000 |
| | 3 | — | 72,000 |
| Vapor Combustion Units 160 | 1 | — | 50,000 |
| | 2 | — | 100,000 |

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure.

Other changes, substitutions, and alterations are also possible without departing from the spirit and scope of the present disclosure.

What is claimed is:

1. A method, comprising:

receiving an input comprising:

a specified fluid product to be transported;

a specified volume transfer of the specified fluid product to a berth; and a target flow rate of the specified fluid product;

determining a first allowable operating range for volume transfer and a second allowable operating range for flow rate at least based on:

the specified fluid product;

an availability of meters for metering;

an availability of loading arms for loading the specified fluid product to a ship located at the berth; and an availability of vapor combustion units for flaring;

transmitting a control signal to at least one of a plurality of valves to establish a flow path for the specified fluid product through the meters available for metering, through the loading arms available for loading, and to the ship located at the berth;

transmitting a start signal to initiate a recipe that controls flow through the flow path within the first allowable operating range and the second allowable operating range;

monitoring the plurality of source tanks, the plurality of pumps, the meters, the loading arms, and the vapor combustion units for a change in state;

in response to detecting the change in state, displaying a notification that the change in state has been detected; and transmitting a stop signal to terminate the recipe in response to not receiving a second input within a predetermined time period after the notification has been displayed.

2. The method of claim 1, wherein:

the input comprises a selection of at least one of a plurality of source tanks and a selection of at least one of a plurality of pumps;

each of the plurality of source tanks stores fluid of one of a plurality of product types; and the method comprises verifying that the specified fluid product matches the product type of the selection of the at least one of the plurality of source tanks.

3. The method of claim 2, wherein transmitting the control signal to at least one of the plurality of valves comprises:

transmitting a close signal to each of a first portion of the plurality of valves, resulting in shifting the first portion of the plurality of valves to a closed state; and transmitting an open signal to each of a second portion of the plurality of valves, resulting in shifting the second portion of the plurality of valves to an open state, such that the first portion of the plurality of valves in the closed state and the second portion of the plurality of valves in the open state establish the flow path.

4. The method of claim 3, comprising, after transmitting the close signal to each of the first portion of the plurality of valves and after transmitting the open signal to each of the second portion of the plurality of valves, verifying whether a conflict exists in the flow path established.

5. The method of claim 4, wherein verifying whether a conflict exists in the flow path established comprises determining at least one of:

any of the selection of the at least one of the plurality of source tanks is in fluid communication with an inbound pipeline or an inbound berth flush line;

any of the selection of the at least one of the plurality of source tanks is in fluid communication with a flush pump suction;

any of the selection of the at least one of the plurality of source tanks is in fluid communication with any of the plurality of pumps that is not in the selection of the at least one of the plurality of pumps;

any of the selection of the at least one of the plurality of pumps is in fluid communication with any of the plurality of source tanks that is not in the selection of the at least one of the plurality of source tanks;

a berth cargo line is not in fluid communication with a pump discharge;

a discharge of any of the selection of the at least one of the plurality of pumps is not in fluid communication with the berth cargo line; or the berth cargo line is in fluid communication with a discharge of any of the plurality of pumps that is not in the selection of the at least one of the plurality of pumps.

6. The method of claim 1, comprising transmitting a stop signal to terminate the recipe in response to detecting the change in state.

7. The method of claim 1, comprising:

receiving a second input after displaying the notification; and in response to receiving the second input, displaying a confirmation request repeatedly at a predetermined rate until the recipe has completed.

8. (Withdrawn — Currently Amended) A hydrocarbon transport marine terminal system, comprising:

a plurality of source tanks;

a plurality of pumps;

a plurality of meters;

a plurality of loading arms;

a plurality of vapor combustion units;

a berth; and a flow system comprising:

a network of piping connecting the plurality of source tanks, the plurality of pumps, the plurality of meters, the plurality of loading arms, and the plurality of vapor combustion units;

a plurality of valves installed in the network of piping; and a computer comprising:

a processor; and a non-transitory computer-readable storage medium coupled to the processor and storing programming instructions for execution by the processor, the programming instructions instructing the processor to perform operations comprising:

receiving an input comprising:

a specified fluid product to be transported;

a specified volume transfer of the specified fluid product to the berth; and a target flow rate of the specified fluid product;

determining a first allowable operating range for volume transfer and a second allowable operating range for flow rate at least based on:

the specified fluid product;

an availability of meters for metering;

an availability of loading arms for loading the specified fluid product to a ship located at the berth; and an availability of vapor combustion units for flaring;

transmitting a control signal to at least one of the plurality of valves to establish a flow path for the specified fluid product through the meters available for metering, through the loading arms available for loading, and to the ship located at the berth;

transmitting a start signal to initiate a recipe that controls flow through the flow path within the first allowable operating range and the second allowable operating range;

monitoring the plurality of source tanks, the plurality of pumps, the meters, the loading arms, and the vapor combustion units for a change in state; and in response to detecting the change in state, displaying a notification that the change in state has been detected; and transmitting a stop signal to terminate the recipe in response to not receiving a second input within a predetermined time period after the notification has been displayed.

* * * * *